United States Patent [19]

Elsasser

[11] 4,300,524

[45] Nov. 17, 1981

[54] SAFETY DEVICE FOR CHILD-PROOF GAS STOVE

[76] Inventor: Stephanie Elsasser, 31 Kinghorn St., Staten Island, N.Y. 10312

[21] Appl. No.: 3,555

[22] Filed: Jan. 15, 1979

[51] Int. Cl.[3] ..... F24C 3/00; A21B 1/00

[52] U.S. Cl. ..... 126/39 R; 126/273 R

[58] Field of Search ..... 126/39 R, 39 C, 273 R; 292/26, 97, 123

[56] References Cited

U.S. PATENT DOCUMENTS

| | | | |
|---|---|---|---|
| 2,916,317 | 12/1959 | Diday | 292/26 |
| 2,940,440 | 6/1960 | Chambers | 126/39 C |
| 3,469,568 | 9/1969 | Torrey et al. | 126/39 C |
| 3,561,421 | 2/1971 | Body et al. | 126/273 R |
| 3,586,360 | 6/1971 | Perrotta | 292/26 |
| 3,700,378 | 10/1972 | Scheid | 126/39 R |

*Primary Examiner*—Samuel Scott
*Assistant Examiner*—Wesley S. Ratliff, Jr.
*Attorney, Agent, or Firm*—Jordan and Hamburg

[57] ABSTRACT

An accessory included in a manufacture of a kitchen gas stove for locking shut the gas burners and also the stove doors, the accessory including a hand controlled knob at a back of the stove, the knob turning a valve along a gas incoming pipe, and also turning levers connected to hooks that hook to inner sides of the oven doors and storage drawer therebelow.

1 Claim, 3 Drawing Figures

SAFETY DEVICE FOR CHILD-PROOF GAS STOVE

This invention relates generally to kitchen gas stoves.

It is well known that many fatalities have occured in the past when unattended children, playing in a kitchen, have turned on the gas or crawled into the oven. This is a worrysome situation to parents that has remained to the present times, and has been in want of being prevented.

Accordingly, it is a principal object of the present invention to provide a gas stove that includes a remotely placed device accessible to adults, which controls flow of gas into the stove and at a same time controls the opening of stove doors.

Another object is to provide a child-proof safety device that is quick and easy to turn on or off by simply turning a knob, similarly to a gas burner control knob.

Still a further object is to provide a child-proof safety device which in no way limits the normal stove operation for adults, and which in no way detracts from the stove appearance.

Figure 1:
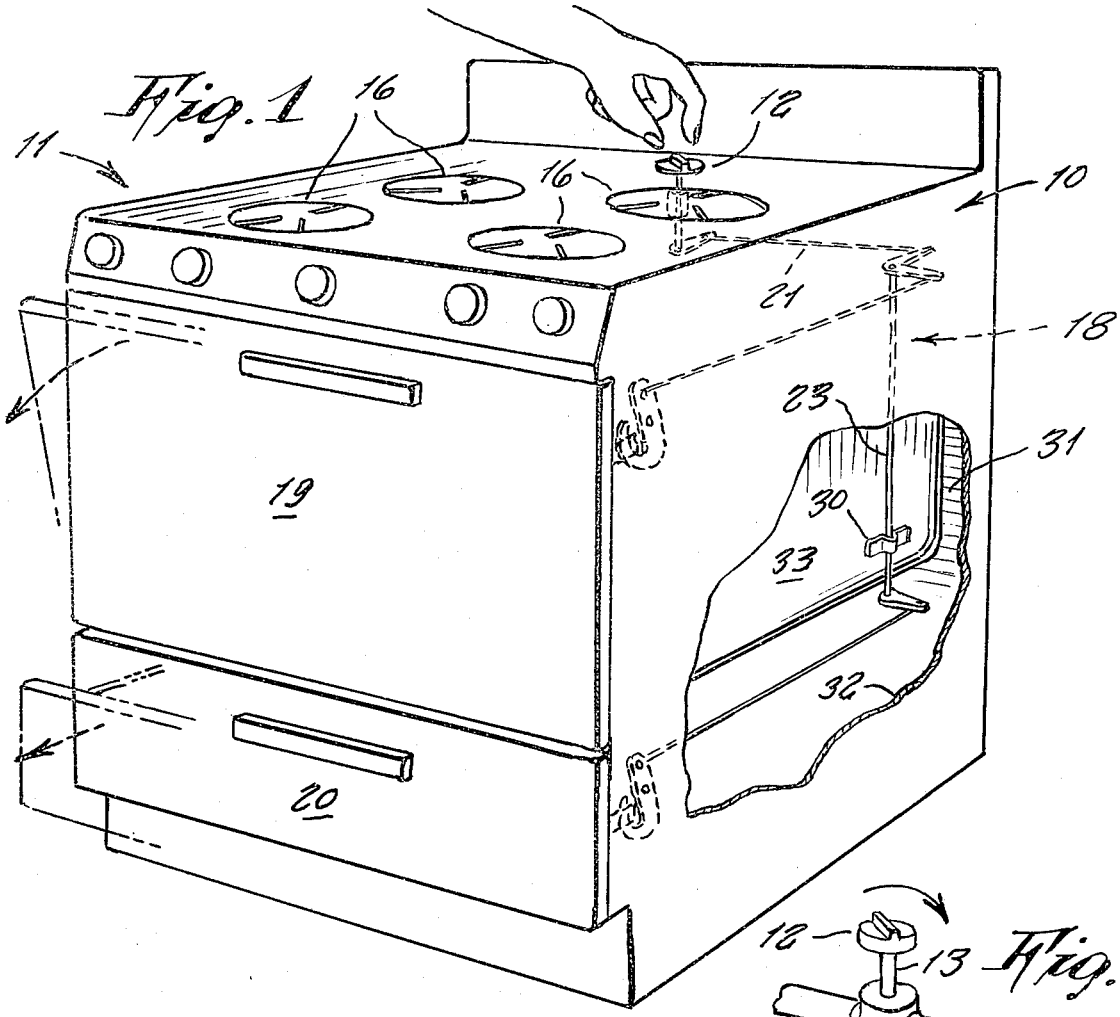
FIG. 1 is a perspective view of a gas stove shown incorporating the present invention.
Figure 2:
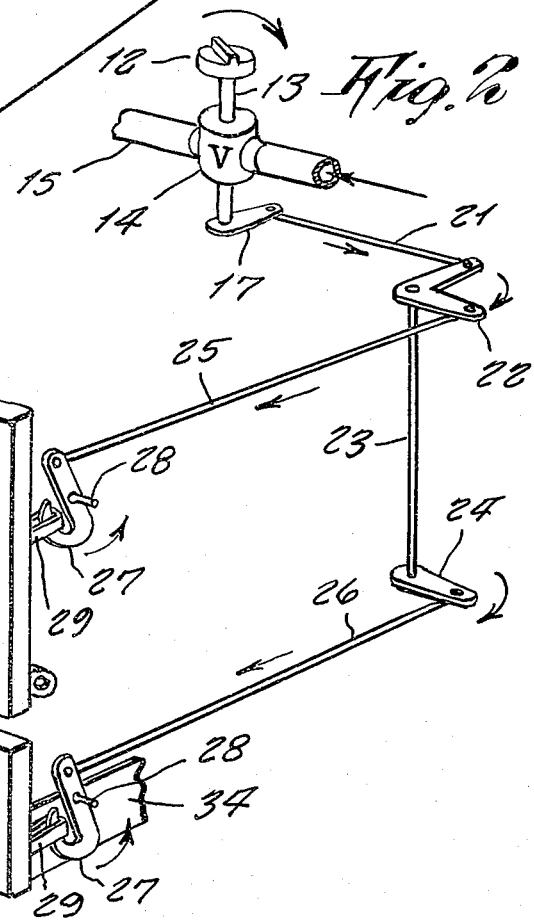
FIG. 2 is an enlarged detail of the invention mechanism, and showing the control knob serving to shut off the gas to the entire stove at a same time when it keeps the oven door and stove bottom drainer locked.

Referring now to the drawing in greater detail, the reference numeral 10 represents a child-proof safety device according to the present invention and which is incorporated in a kitchen gas stove 11. The device includes a rotatable control knob 12 located far back upon a top of the stove so to not be easily accessible to a child but which can be readily reached by an adult.

The knob is mounted on an upper end of a shaft 13 extending through a valve 14 located along a main gas supply line 15 which leads to the stove burners 16 and to the oven burners, not shown.

A lower end of the shaft 13 has a lever arm 17 affixed thereto which operates a lock mechanism 18 for selectively locking or unlocking the stove oven door (or doors) 19 and a storage drawer 20 in which pots and pans are usually stored away.

The lock mechanism includes pushrod 21 turning right angle lever 22 affixed on a rotatably supported rod 23 to which a lever arm 24 is affixed. A plurality of pushrods 25 and 26 are attached to the lever 22 and arm so to each pivot a hook 27 pivotable about stationary pivot pins 28 in order to simultaneously engage (or disengage) the hooks in rings 29 affixed on inner or hidden areas of the door 19 and drawer 20. It is understood that the rod 23 and the pins 28 are supported rotatably free in brackets 30 (or the like) stationarily mounted inside the stove structure, and located in the space 31 between the stove outer wall 32 and the oven shell 33 or drawer side wall 34.

In operative use, a quarter turn of the knob in one direction shuts off gas to the burners and locks the door and drawer closed.

Figure 3:
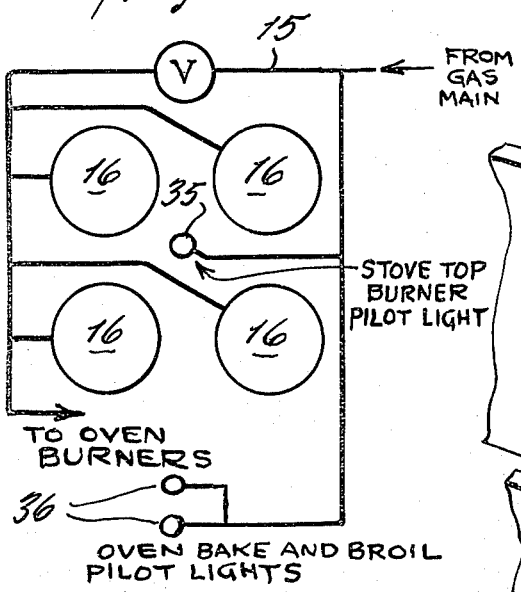
FIG. 3 is a diagram of the gas valve intercepting the gas line between the city supply main and all the stove burners.

As shown in FIG. 3, the pilot lights 35 and 36 are connected to the gas line 15 ahead of the valve 14 so that the pilot lights are not affected by shutting of the valve, and thus the pilot lights always remain on, ready for use, and matches are not needed.

What is claimed:

1. In a child-proof safety device for a kitchen gas stove including a plurality of stove top burners, at least one oven, control means for each burner, a storage drawer and a locking mechanism having hooks and levers connected thereto to lock or unlock a door of said oven and said storage drawer, the improvement comprising a main gas valve located in a main gas supply line in the gas stove for supplying gas to all the burners having the respective control means, said main gas valve having a shaft, a valve body attached to said shaft and a knob for turning said shaft to shut off the main gas valve, said knob being provided on a top-rear section of the stove for preventing a child from handling the knob, said levers of said locking mechanism being connected to said shaft to be moved together with said valve body by the knob, whereby when said main gas valve is turned off, the oven and the storage drawer cannot be opened and all the burners cannot be used.

* * * * *